United States Patent [19]

Uetsuhara et al.

[11] Patent Number: 4,845,451

[45] Date of Patent: Jul. 4, 1989

[54] ELECTROMAGNET

[75] Inventors: Tokio Uetsuhara, Urawa; Kenji Iio; Yuichi Andoh, both of Kurata, all of Japan

[73] Assignees: Mitsubishi Mining & Cement Co., Ltd., Tokyo; Osaka Gas Co., Ltd., Osaka, both of Japan

[21] Appl. No.: 218,659

[22] Filed: Jul. 13, 1988

[30] Foreign Application Priority Data

Jul. 23, 1987 [JP] Japan ..... 62-182335
Sep. 10, 1987 [JP] Japan ..... 62-225166

[51] Int. Cl.[4] ..... H01F 7/08

[52] U.S. Cl. ..... 335/257; 335/271; 335/277

[58] Field of Search ..... 335/251, 255, 257, 271, 335/277

[56] References Cited

U.S. PATENT DOCUMENTS 2,671,187 3/1954 Jencks ..... 335/257
2,735,047 2/1956 Garner et al. ..... 335/257 X
4,638,279 1/1987 Brisson et al. ..... 335/277 X

*Primary Examiner*—George Harris

*Attorney, Agent, or Firm*—Bierman and Muserlian

[57] ABSTRACT

The present invention provides an improvement for noise suppression, in an electromagnet constructed of the parts including a yoke, a fixed iron core fixed relative to the yoke, a movable iron core capable of being attracted toward and coming apart from the fixed iron core and a coiled wire wound around the magnetic path formed of the yoke, fixed iron core and movable iron core which serves to attract the movable iron core toward the fixed iron core by means of the magnetic flux induced by passing an electric current therethrough, which comprises dividing either one of the fixed iron core and the movable iron core into a body member and an end-surface member, at which the fixed and movable iron cores are contacted with each other, providing an elastic insert member between the body member and the end-surface member of the iron core in such a manner as not to interrupt the path of the magnetic flux and, optionally, providing a spring means which urges a stem supporting the end-surface member in such a manner that the end-surface member is pressed against the elastic insert member with a predetermined pressure.

2 Claims, 6 Drawing Sheets

ELECTROMAGNET

BACKGROUND OF THE INVENTION

The present invention relates to an electromagnet or, more particularly, to an electromagnet which is characterized by the greatly decreased noise when the movable iron core hits the fixed iron core by being attracted thereby and by the uniformity of the ampere-turn required for holding the movable iron core attracted on the fixed iron core.

As is illustrated in FIG. 9 of the accompanying drawing, a conventional electromagnet is typically constructed of the parts including a yoke 1, a fixed iron core 2 fixed relative to the yoke 1, a movable iron core 4 which is attracted by and coming apart from the fixed iron core 2 and a coiled wire 3 wound around the magnetic path formed of the yoke 1, fixed iron core 2 and movable iron core 4 which serves to attract the movable iron core 4 toward the fixed iron core 2 by means of the magnetic flux 5 induced by passing an electric current therethrough.

When the coil 3 is energized and movable iron core 4 is attracted toward and hits the fixed iron core 2, a sharp noise is unavoidably caused more or less by the bumping of the two metal-made parts. This noise generation can sometimes be a serious problem, especially, when the electromagnet is built in a household electric appliance. A conventional measure undertaken to reduce the noise generation in the electromagnet is to provide a covering member 6 made of an elastic material such as rubbers and plastics on the end surface 2*a* of the fixed iron core 2 or on the end surface 4*a* of the movable iron core 4.

Such an electromagnet having an elastic covering member 6 on the end surface of the fixed iron core 2 or movable iron core 4 has several problems. For example, the elastic covering member 6 made of a non-magnetic material such as rubbers is provied across the path of the magnetic flux 5 so that the permeance is decreased consequently resulting in a decrease of the attracting force. Since the elastic covering member 6 is repeatedly bumped directly by the fixed iron core 2 or movable iron core 4 made of a magnetic material, the elastic covering member 6 is unavoidably worn out in the long run to produce dusts so that the attracting behavior of the electromagnet is degraded with a decrease in the serviceable life of the electromagnet. Moreover, the noise-suppressing effect and the value of ampere-turn required for obtaining a desired attracting force are not always reproducible when a large number of electromagnets are mass-produced.

SUMMARY OF THE INVENTION

The present invention accordingly has an object to provide an electromagnet in which the above described problems and disadvantages in the prior art electromagnets have been dissolved. Namely, the present invention has an object to provide an electromagnet having good characteristic relative to the attracting force and a long serviceable life with greatly decreased noise generation by bumping of the fixed and movable iron cores along with uniform reproducibility of the noise-suppressing effect and the value of ampere-turn required for obtaining a desired attracting force.

The present invention provides an improvement which comprises, in an electromagnet constructed of the parts including a yoke, a fixed iron core fixed relative to the yoke, a movable iron core capable of being attracted toward and coming apart from the fixed iron core and a coiled wire wound around the magnetic path formed of the yoke, fixed iron core and movable iron core which serves to attract the movable iron core toward the fixed iron core by means of the magnetic flux induced by passing an electric current therethrough, dividing either one of the fixed iron core and the movable iron core into a body member and an end-surface member, at which the two iron cores are contacted with each other when the movable iron core is attracted toward the fixed iron core, and providing an elastic insert member between the body member and the end-surface member of the iron core in such a manner as not to interrupt the magnetic flux.

The improvement of the present invention further comprises, in addition to the elastic insert member provided between the body member and the end-surface member of the iron core in such a manner as not to interrupt the magnetic flux, providing a stem which supports the end-surface member and a spring means to urge the end-surface member against the elastic insert member with a constant pressure.

DETAILED DESCRIPTION OF THE PREFERRED EMBODIMENTS

As is described above, the most characteristic feature of the inventive improvement is that, in an electromagnet, either one of the fixed iron core and the movable iron core is divided into a body member and an end-surface member to which the other iron core is magnetically attracted and an elastic insert member is provided between the body member and the end-surface member in such a manner that the magnetic flux induced by means of the coiled wire is not interrupted not to cause any adverse influences on the magnetically attracting behavior of the electromagnet. Different from conventional electromagnets in which an elastic member is bonded to the end surface of an iron core, the elastic insert member according to the invention is free from direct bumping of the iron core so that the electromagnet is imparted with a greatly extended serviceable life which otherwise is limited by the degradation of the elastic member as a result of the repeated bumping of the iron core.

Another advantage obtained by the inventive improvement is that, when the fixed and movable iron cores are held together in contact after completion of attraction of the movable iron core toward the fixed iron core, a constant-current working performance can be exhibited with a rating magnetization ampere-turn or less because the adverse effect due to the variation or unevenness in the dimensions of the contacting surfaces can be absorbed by the contraction and expansion of the elastic member so that the variation in the magnetization ampere-turn required for attraction or attracting force is minimized.

Furthermore, the end-surface member is pressed against the body member of the iron core always with a constant pressing force by a spring means so that the vibration of the elastic member caused by bumping of the iron core can be attenuated uniformly and rapidly, when a large number of the electromagnets are manufactured in a mass-production system. In addition, the reproducibility and reliability of the products relative to the uniform requirement for the value of ampere-turn and the noise suppressing effect can be greatly improved due to the minimized variation in the contacting condition of the fixed and movable iron cores unavoidable as a consequence of the dimensional errors of the individual parts as fabricated.

In the following, the improvement according to the present invention is described in detail with reference to the accompanying drawing.

Figure 1A:
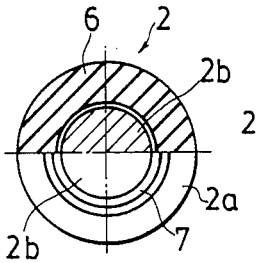
FIGS. 1(*a*) and 1(*b*) are each a partial cross sectional view of an electromagnet as a first embodiment of the invention and FIG. 1(*c*) is a plan view of a part used therein.
Figure 1B:
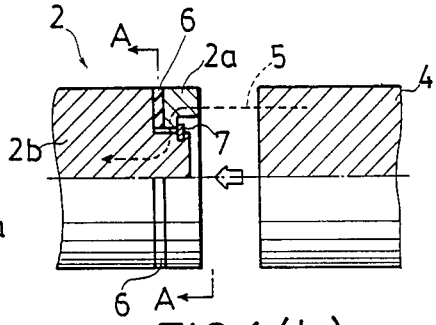
Figure 1C:
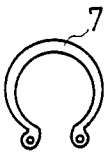
Figure 9:
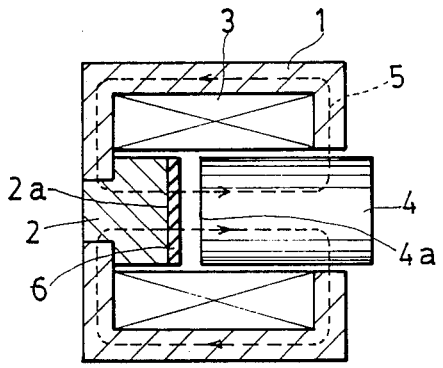
FIG. 9 PRIOR ART
FIG. 9 is a cross sectional view of a conventional electromagnet in the prior art.

FIGS. 1(*a*) and 1(*b*) illustrate an electromagnet according to a first embodiment of the improvement, of which FIG. 1(*a*) is a partial cross sectional view of the same as cut and viewed along the arrows A—A in FIG. 1(*b*). The iron cores illustrated in these figures are the same in the structure as those of the conventional electromagnet illustrated in FIG. 9 excepting for the following. Namely, the fixed iron core 2 is divided into the end-surface member 2*a* which is contacted by the movable iron core 4 and the body member 2*b* connected to the yoke 1. Further, an elastic member 6 is inserted between the end-surface member 2*a* and the body member 2*b* in such a disposition that it is not across the magnetic flux 5. The end-surface member 2*a* and the body member 2*b* are conjoined together by means of a clip 7 illustrated in FIG. 1(*c*).

Figure 2A:
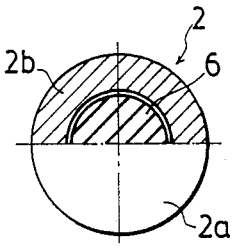
FIGS. 2(*a*) and 2(*b*) are each a partial cross sectional view of an electromagnet as a second embodiment of the invention.
Figure 2B:
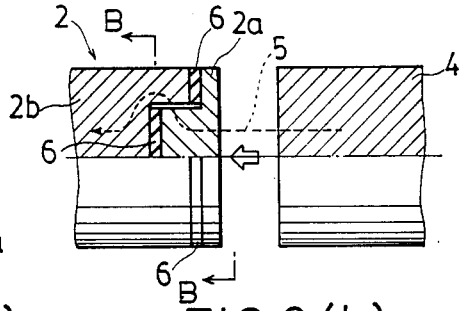

FIGS. 2(*a*) and 2(*b*) illustrate a second embodiment according to the invention, of which FIG. 2(*a*) is a partial cross sectional view of the iron as cut and viewed along the arrows B—B in FIG. 2(*b*). Separate elastic insert members 6 are provided between the end-surface member 2*a* and the body member 2*b*.

Figure 3A:
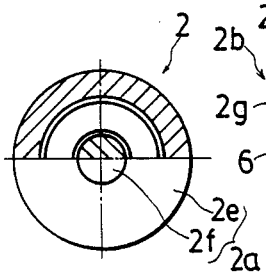
FIGS. 3(*a*) and 3(*b*) are each a partial cross sectional view of an electromagnet as a third embodiment of the invention.
Figure 3B:
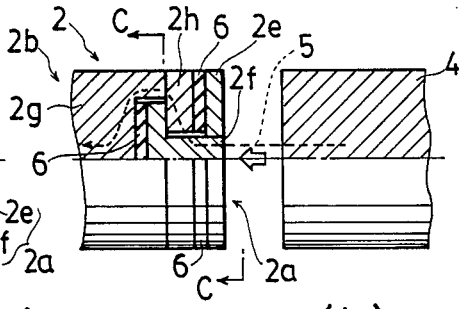

FIGS. 3(*a*) and 3(*b*) illustrate a third embodiment according to the invention, of which FIG. 3(*a*) is a partial cross sectional view of the iron cores as cut and viewd along the arrows C—C in FIG. 3(*b*). Separate elastic insert members 6 are provided between the end-surface member 2*a* and the body member 2*b* while the end-surface member 2*a* is constructed of a ring-like member 2*e* and a core member 2*f* adhesively bonded together and the body member 2*b* is constructed of a ring-like member 2*h* and a base member 2*g* adhesively bonded together, the end-surface member 2*a* and the body member 2*b* being conjoined together engagedly.

It is of course optional that, instead of dividing the fixed iron core 2 into the end-surface member 2*a* and the body member 2*b* as in the above described first to third embodiments, the movable iron core 4 is divided into an end-surface member and a body member with an elastic insert member intervening therebetween.

Figure 4:
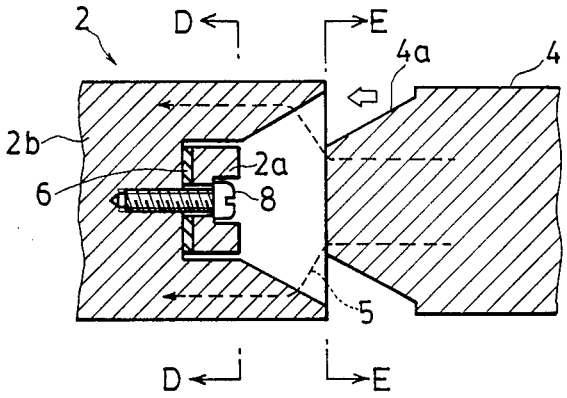
FIGS. 4(*a*) and 4(*b*) are each a partial cross sectional view of an electromagnet as a fourth embodiment of the invention and FIG. 4(*c*) is a cross sectional view of the same as cut and viewed along the arrows E—E in FIG. 4(*a*).
Figure 4:
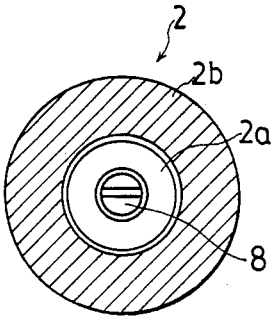
Figure 4:
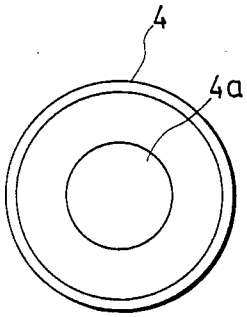

FIG. 4(*a*) illustrates an axial cross sectional view of iron cores as a fourth embodiment according to the invention. FIG. 4(*b*) is a cross sectional view of the fixed iron core 2 as cut and viewed along the arrows D—D in FIG. 4(*a*). FIG. 4(*c*) illustrates the movable iron core 4 in FIG. 4(*a*) as viewed along the arrows E—E in FIG. 4(*a*). The fixed iron core 2 has a recess to face the movable iron core 4 which had a conically shaped end portion 4*a* which fits the recess in the fixed iron core when the movable iron core 4 is attracted to the fixed iron core 2. The end-surface member 2*a* is joined to the body member 2*b* by means of a screw 8 with the elastic insert member 6 intervening therebetween.

Figure 5:
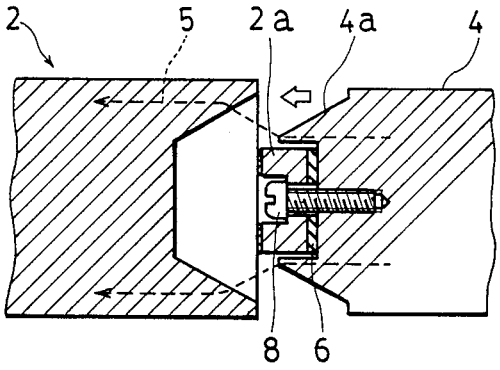
FIG. 5 is a partial cross sectional view of an electromagnet as a fifth embodiment of the invention.

In the iron cores illustrated in FIG. 5 as a fifth embodiment of the invention by an axial cross sectional view, the end-surface member 2*a* is joined to the conically shaped end portion 4*a* of the movable iron core 4 by means of a screw 8 with the elastic insert member 6 intervening therebetween to fit the recess in the end portion of the fixed iron core 2 when the movable iron core 4 is attracted to the fixed iron core 2 instead of dividing the fixed iron core 2 illustrated in FIG. 4 into an end-surface member and a body member.

Figure 6:
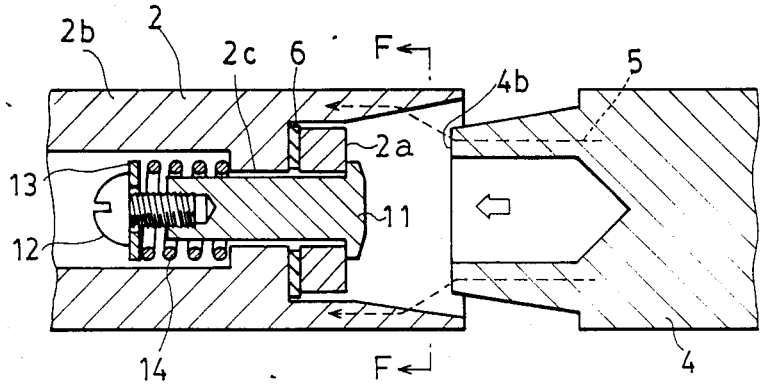
FIGS. 6(*a*) and 6(*b*) are each a partial cross sectional view of an electromagnet as a sixth embodiment of the invention and FIG. 7 is a partial cross sectional view of the same as cut and viewed along the arrows F—F in FIG. 6(*a*).
Figure 6:
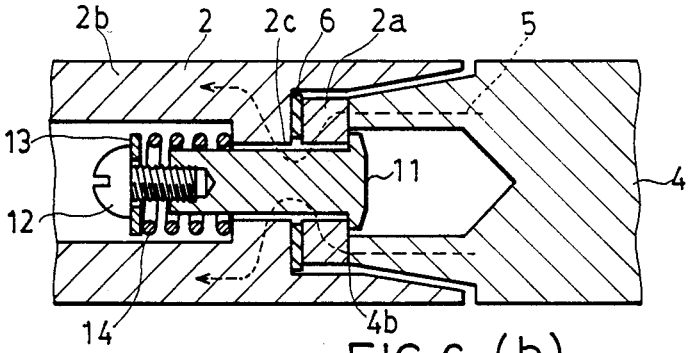
Figure 7:
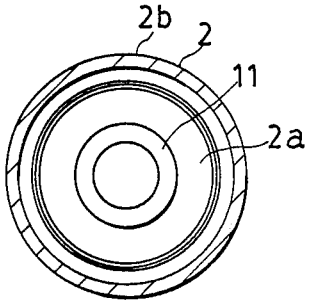

FIGS. 6(*a*) and 6(*b*) each illustrate a partial cross sectional view of iron cores as a sixth embodiment according to the present invention and FIG. 7 illustrates an axial view of the same fixed iron core as viewed along the arrows F—F in FIG. 6(*a*). The fixed iron core 2 is divided into an end-surface member 2*a* at which the movable iron core 4 is contacted with the fixed iron core 2 and a body member 2*b* and an elastic insert member 6 is provided between the end-surface member 2*a* and the body member 2*b* in such a manner as not to interrupt the magnetic flux along the magnetic path.

The end-surface member 2*a* of the fixed iron core 2 made of a magnetic material is brought into contact with the end surface 4*b* of the movable iron core 4.

The end-surface member 2*a* is helped by a stem 11 which penetrates a hole 2*c* provided along the axis of the body member 2*b* and is fixed to the body member 2*b* by means of a screw 12 and a washer 13 at the end remote from the end-surface member 2*a*. A coil spring 14 surrounding the stem 11 is provided between the washer 13 and the body member 2*b* in such a manner that the end-surface member 2*a* is always pressed against the elastic insert member 6 with the elastic resilience of the spring 14. The elastic resilience of the coil spring 14, with which the end-surface member 2*a* is pressed against the elastic insert member 6, can be controlled as desired by adequately driving the screw 12 into or out of the female in the stem 11.

FIG. 6(*a*) illustrates the fixed iron core 2 and the movable iron core 4 which are apart from each other with the electromagnet in an unenergized condition. FIG. 6(*b*) illustrates the fixed and movable iron cores 2, 4 in contact with each other by means of the magnetic flux 5 generated when the electromagnet is energized.

Figure 8A:
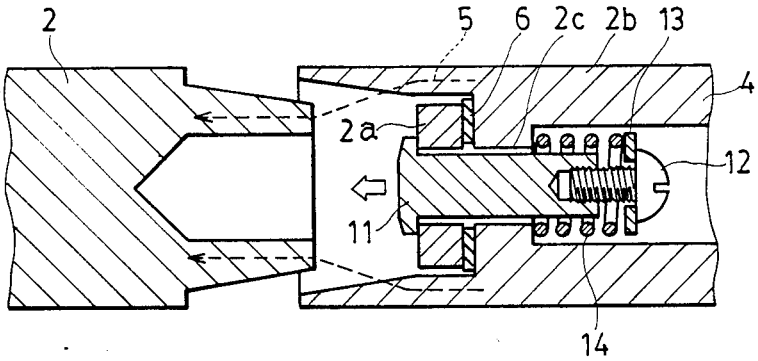
FIGS. 8(*a*) and 8(*b*) are each a partial cross sectional view of an electromagnet as a seventh embodiment of the invention.
Figure 8B:
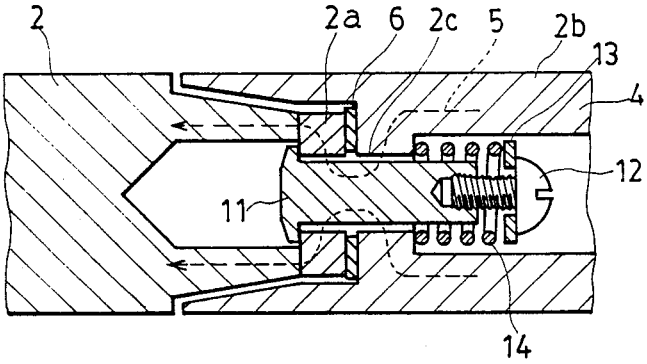

FIGS. 8(*a*) and 8(*b*) each illustrate a partial cross sectional view of iron cores as a seventh embodiment according to the present invention. Different from the embodiment illustrated in FIG. 6, the movable iron core 4 in these figures is divided into an end-surface member 2*a* and a body member 2*b*.

What is claimed is:

1. In an electromagnet constructed of the parts including a yoke, a fixed iron core fixed relative to the yoke, a movable iron core capable of being attracted toward and coming apart from the fixed iron core and a coiled wire wound around the magnetic path formed of the yoke, fixed iron core and movable iron core which serves to attract the movable iron core toward the fixed iron core by means of the magnetic flux induced by passing an electric current therethrough, an improvement which comprises dividing either one of the fixed iron core and the movable iron core into a body member and an end-surface member, at which the fixed and movable iron cores are contacted with each other, and providing an elastic insert member between the body member and the end-surface member of the iron core in such a manner as not to interrupt the magnetic flux.

2. In an electromagnetic constructed of the parts including a yoke, a fixed iron core fixed relative to the yoke, a movable iron core capable of being attracted toward and coming apart from the fixed iron core and a coiled wire wound around the magnetic path formed of the yoke, fixed iron core and movable iron core which serves to attract the movable iron core toward the fixed iron core by means of the magnetic flux induced by passing an electric current therethrough, an improvement which comprises dividing either one of the fixed iron core and the movable iron core into a body member and an end-surface member, at which the fixed and movable iron cores are contacted with each other, providing an elastic insert member between the body member and the end-surface member of the iron core in such a manner as not to interrupt the magnetic flux and providing a spring means which urges a stem supporting the end-surface member in such a manner that the end-surface member is pressed against the elastic insert member with a predetermined pressure.

* * * * *